US005310354A

United States Patent [19]

Oswald, Jr.

[11] Patent Number: 5,310,354

[45] Date of Patent: May 10, 1994

[54] INTEGRAL GROUND TERMINAL AND TAIL SHIELD

[75] Inventor: Joseph A. Oswald, Jr., Mechanicsburg, Pa.

[73] Assignee: E. I. Du Pont de Nemours and Company, Wilmington, Del.

[21] Appl. No.: 28,772

[22] Filed: Feb. 17, 1993

Related U.S. Application Data

[63] Continuation of Ser. No. 854,159, Mar. 19, 1992, abandoned.

[51] Int. Cl.[5] ..... H01R 13/658

[52] U.S. Cl. ..... 439/108; 439/608

[58] Field of Search ..... 439/101, 108, 607, 608

[56] References Cited

U.S. PATENT DOCUMENTS

| | | | |
|---|---|---|---|
| 3,399,372 | 8/1968 | Uberbacher | 439/60 |
| 4,558,917 | 12/1985 | Kamono et al. | 439/608 |
| 4,601,527 | 7/1986 | Lemke | 439/81 |
| 4,655,518 | 4/1987 | Johnson et al. | 439/80 |
| 4,686,607 | 8/1987 | Johnson | 439/65 |
| 4,824,383 | 4/1989 | Lemke | 439/108 |
| 4,867,707 | 9/1989 | Widdoes | 439/675 |
| 4,869,677 | 9/1989 | Johnson et al. | 439/80 |
| 4,898,546 | 2/1990 | Elco et al. | 439/608 |
| 4,914,062 | 4/1990 | Voltz | 439/608 |
| 5,133,679 | 7/1992 | Fusselman et al. | 439/608 |
| 5,135,405 | 8/1992 | Fusselman et al. | 439/108 |
| 5,197,893 | 3/1993 | Morlion et al. | 439/101 |

FOREIGN PATENT DOCUMENTS 0337634 3/1989 European Pat. Off. .

*Primary Examiner*—Gary F. Paumen

*Attorney, Agent, or Firm*—Woodcock Washburn Kurtz Mackiewicz & Norris

[57] ABSTRACT

The present invention relates to integral ground terminals and tail shields for cross talk control between signal carrying conductors in connectors and, in particular, where the connector is a right angle receptacle or a right angle header.

9 Claims, 4 Drawing Sheets

INTEGRAL GROUND TERMINAL AND TAIL SHIELD

This is a continuation-in-part of application Ser. No. 07/854,159 filed Mar. 20, 1992, now abandoned.

BACKGROUND OF THE INVENTION

1. Field of the Invention

This invention relates to integral ground terminals and tail shields for cross talk control between signal carrying conductors in connectors and, in particular, where the connector is a right angle receptacle or a right angle header.

2. Description of Related Art

With the advance of technology, a high density of electronic circuits and components can be located on a printed wiring board or printed circuit board (PCB). Along with this miniaturization of electronic circuits and components, electrical connectors are needed to electrically and mechanically interconnect one PCB, such as a back panel or mother board, to one or more other PCBs, such as daughter boards. Further, it is typically desirable for such connectors to have a high signal density capacity. That is, the connectors should permit a high number of signals to pass through the connector per unit volume of the connector. However, electrical signals carried on a conductor can interfere with a signal carried on an adjacent conductor.

This interfering electrical effect that an electrical signal carried on a given conductor exerts on a signal carried on an adjacent conductor is referred to as "cross talk." Controlling this cross talk is especially important in high density connectors. Such control can be implemented in a variety of ways.

One method of controlling cross talk is to connect certain terminals in a high density connector to conductive areas of a printed circuit board that are in turn grounded or connected to a predetermined ground potential. This solution is external to the connector.

U.S. Pat. No. 4,655,518 (to Lennart B. Johnson et al.), U.S. Pat. No. 4,686,607 (to Lennart B. Johnson) and U.S. Pat. No. 4,869,677 (to Lennart B. Johnson et al.) disclose a daughter board/backplane assembly with contact elements dedicated for grounding purposes. Header contact elements have contacts that can be connected to ground or a predetermined potential on a backplane. The header contact elements have other spring contacts carried by an inside header wall for touching contacts carried by a right angle receptacle outer wall. Other contacts are integral with and perpendicular to the contacts carried by the right angle receptacle outer wall for connection to the daughter board.

U.S. Pat. No. 4,601,527 issued to Timothy A. Lemke discloses an internal shielding structure for connectors, specifically in vertical and right angle headers. The shielding structure includes a ground strip affixed to a mating surface of a header housing. The shielding structure further includes an elongated conductive spring contact with contact beams that extend in holes of side walls of the housing, lock tabs that connect to the ground strip and ground bars for connection to a grounded chassis.

U.S. Pat. No. 4,824,383 issued to Timothy A. Lemke discloses a shielding structure in connectors or plug-type terminators for either a multiple conductor cable or a multiple tracing substrate that electrically isolates individual or groups of contact elements in the terminator to prevent or minimize cross talk between adjacent conductors and to prevent or minimize degradation of signal transmission. The terminator includes a ground structure with generally U-shaped channels. Contact elements extend into the channels. The ground structure is connected to a predetermined potential, rather than dedicating some of the contact elements for this purpose.

U.S. Pat. No. 4,898,546 issued to Richard A. Elco et al. discloses a ground shield device for right angle connectors. A different one of the shield devices straddles alternate columns of contact elements in the connector. Each shield device clips to a tail of one of the contact elements straddled by the shield device. The shield devices are connected to ground or a predetermined potential.

It is an object of this invention to provide an integral ground terminal and tail shield for use in a high density electrical connector for electrically and mechanically interconnecting electronic circuits and/or components controlling cross talk within the connector.

Furthermore, it is an object of this invention to provide an integral ground terminal and tail shield for use in a high density angled or right angle electrical receptacle or header for electrically and mechanically interconnecting a circuit assembly and a plurality of terminals arranged in rows and columns in a mating connector to control cross talk thereby to reduce or minimize degradation of signal transmission within the receptacle or header.

These and other objects are satisfied in the subject invention which will be clear from the following description.

SUMMARY OF THE INVENTION

The invention relates to an integral ground terminal and tail shield, comprising:

- a first contact end portion for contacting a mating terminal contact portion;
- a first, substantially flat, longitudinal, tail portion connected to the first contact end portion;
- a second, substantially flat, longitudinal, tail portion connected to the first tail portion at a bend;
- a second contact end portion terminating the second tail portion, the second contact end portion for being connected to a circuit assembly;
- a first, substantially flat, shield member integrally connected to at least one of the first tail portion and the second tail portion, the first shield member at least electrically contacting the other one of the first tail portion and the second tail portion, the first shield member being substantially perpendicular to the first tail portion and the second tail portion; and
- a second, substantially flat, shield member integrally connected to at least one of the first tail portion and the second tail portion, the second shield member at least electrically contacting the other one of the first tail portion and the second tail portion, the second shield member being substantially perpendicular to the first tail portion and the second tail portion.

BRIEF DESCRIPTION OF THE DRAWINGS

The invention can be more fully understood from the following detailed description thereof in connection with accompanying drawings described as follows.

DESCRIPTION OF THE PREFERRED EMBODIMENT(S)

Figure 1:
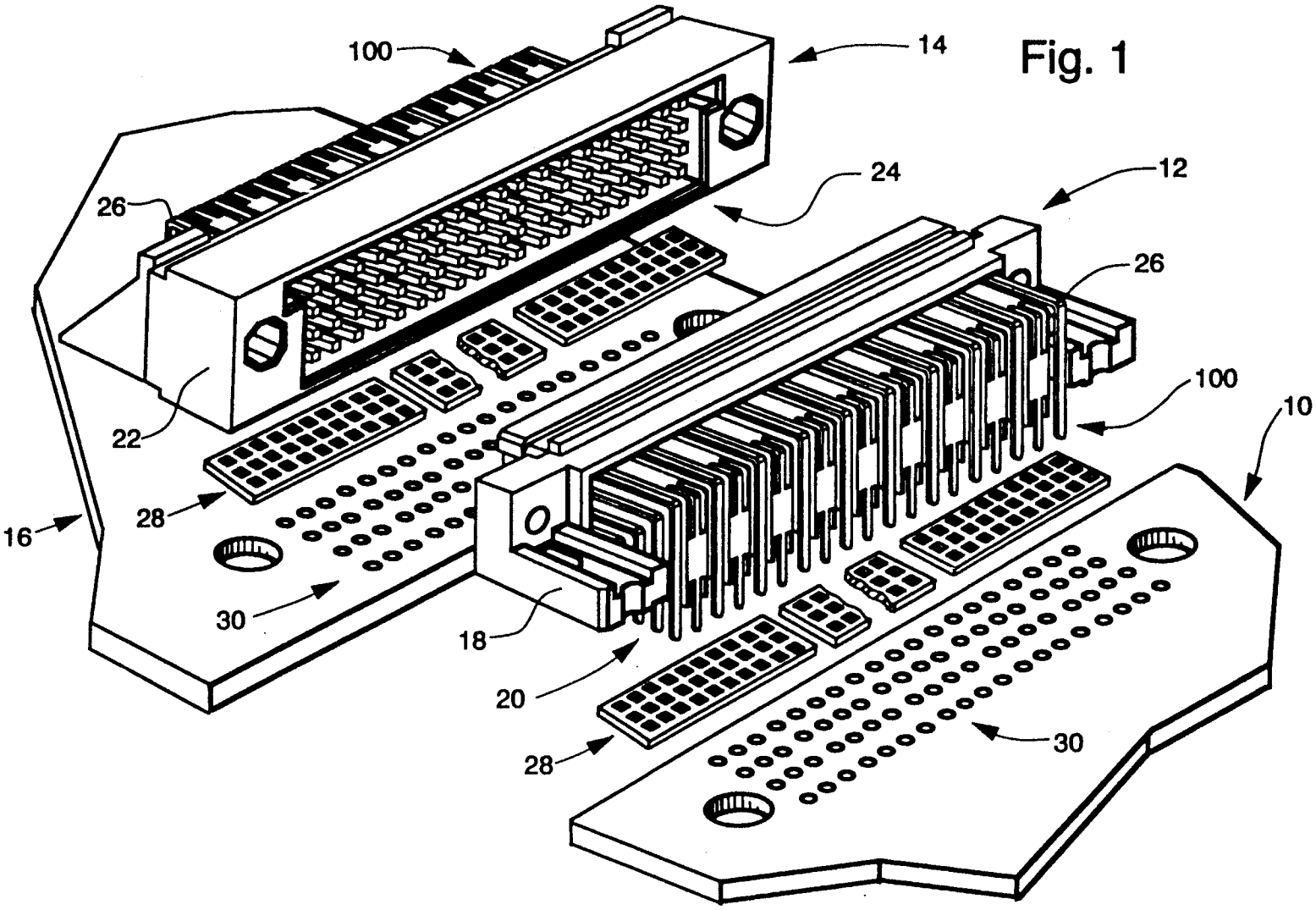
FIG. 1 is a perspective view of a header, a receptacle and a pair of circuit assemblies exploded from one another, the header and receptacle having integral ground terminals and tail shields in accordance with the present invention.

Throughout the following detailed description, similar reference characters refer to similar elements in all figures of the drawings.

Referring to FIG. 1, there is illustrated a connector assembly comprising a first circuit assembly 10, a first connector 12 for connecting to the first circuit assembly 10, a second connector 14 for connecting to the first connector 12, and a second circuit assembly 16 for connecting to the second connector 14. The first connector 12 is depicted as a receptacle having an insulative housing 18 and a plurality of terminals 20 arranged in rows and columns in the housing. The second connector 14 is depicted as a header having an insulative housing 22 and a plurality of terminals 24 arranged in rows and columns in the housing. Both the receptacle 12 and the header 14 are depicted as angled or right angled connectors such that their terminals 20,22 have bends or bent portions 26. In accordance with the present invention, both the receptacle 12 and the header 14 includes at least one integral ground terminal and tail shield 100 in at least one of the columns of the terminals 20,22. Any number of columns of the terminals 20 or 24 can be positioned between adjacent ones of the integral ground terminals and tail shields 100. The receptacle 12 or the header 14 can have any number of the integral ground terminals and tail shields 100 including only one. Preferably and as depicted in FIG. 1, there is one of the integral ground terminals and tail shields 100 in every other column of the terminals 20,22. Preferably and as depicted in FIG. 1, the integral ground terminals and tail shields 100 are in the place of the longest terminal 20,22 in the respective column of terminals 20,22 and shield the tails of all other terminals in the respective column. However, the integral ground terminals and tail shields 100 can be in the place of any of the terminals 20,22 in a column of terminals 20,22. Further, the integral ground terminals and tail shields 100 can shield the tails of a plurality, but less than all, of the terminals in the same column. The connector assembly may also include spacers 28 for maintaining the spacing between the terminals 20,22 of the connectors 12,14 before the terminals 20,22 are inserted in and soldered to plated-through holes 30 in the circuit assemblies 10,16.

Figure 2:
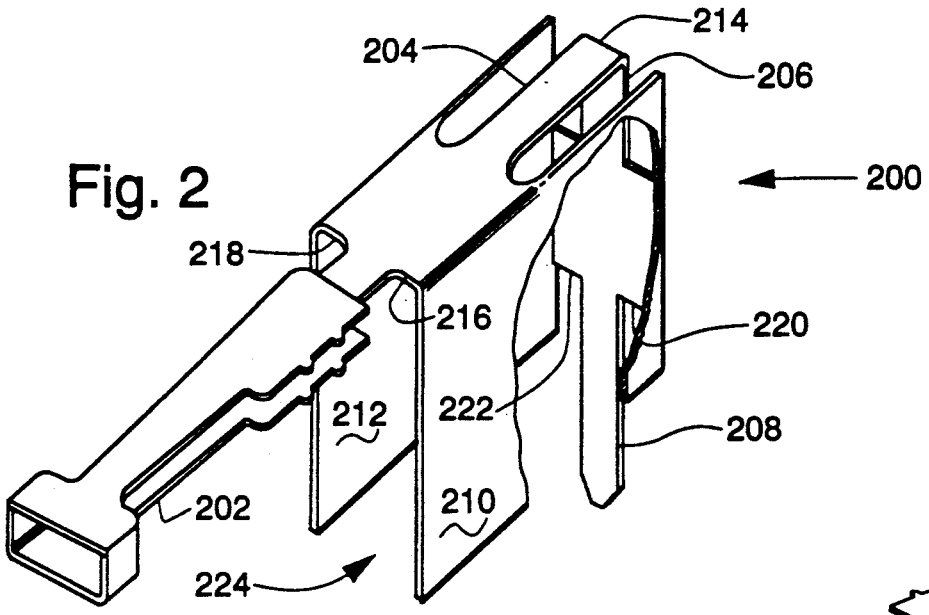
FIG. 2 is an enlarged perspective view of a first embodiment of an integral ground terminal and tail shield for use in a receptacle in accordance with the present invention.

FIG. 2 is an enlarged perspective view of a first embodiment 200 of the integral ground terminal and tail shield 100 for use in the receptacle 12 in accordance with the present invention. Referring to FIG. 2, the integral ground terminal and tail shield 200 comprises a first contact end portion 202, a first tail portion 204, a second tail portion 206, a second contact end portion 208, a first shield member 210, and a second shield member 212. The first contact end portion 202 is for contacting a mating terminal contact portion, such as, a first end portion of one of the terminals 24 of the header 14 illustrated in FIG. 1. The first contact end portion 202 can mate with a mating contact end portion. However, the first contact end portion 202 is illustrated in FIG. 2 as a socket that can be manufactured from a flat sheet of metal. The first tail portion 204 is a substantially flat, longitudinal, tail portion 204 integrally connected to the first contact end portion 202. The second tail portion 206 is a substantially flat, longitudinal, tail portion 206 integrally connected to the first tail portion 204 at a bend or bent portion 214. The bend 214 can be any angle, such as 45 degrees or 90 degrees. The second contact end portion 208 integrally terminates the second tail portion 206. The second contact end portion 208 can have any shape as long as it is adapted to be connected to the circuit assembly 10, such as, by soldering to plated-through holes 30 in the circuit assembly 10. FIG. 2 illustrates the second end portion 208 as a flat solder tail end portion with inclined lead-in edges to facilitate insertion into the plated-through holes 30.

The first tail portion 204 and the second tail portion 206 can have other bends or bent portions in them. Preferably, the first tail portion 204 and the second tail portion 206 are in the shape of a flat strip having substantially parallel sides or edges.

The first shield member 210 is integrally connected to at least one of the first tail portion 204 and the second tail portion 206. In the first embodiment illustrated in FIG. 2, the first shield member 210 is integrally connected to the first tail portion 204. Further, the first shield member 210 is at least electrically contacting the other one of the first tail portion 204 and the second tail portion 206. In the first embodiment illustrated in FIG. 2, the first shield member 210 is electrically and non-integrally contacting the second tail portion 206. As used herein, the term "integral" means formed as a unit with another part. This can be accomplished if both parts are made from the same part and never divided into two distinct parts. Alternatively, two parts that are originally two distinct parts become integral when they are connected together in any permanent fashion, such as by soldering or welding. As used herein, the term "non-integral" means two parts are in contact with or connected to each other such that the two parts can be separated without significant effort or destruction of the parts.

Similarly, the second shield member 212 is integrally connected to at least one of the first tail portion 204 and the second tail portion 206. In the first embodiment illustrated in FIG. 2, the second shield member 212 is integrally connected to the first tail portion 204. Further, the second shield member 212 is at least electrically contacting the other one of the first tail portion 204 and the second tail portion 206. In the first embodiment illustrated in FIG. 2, the second shield member 212 is electrically and non-integrally contacting the second tail portion 206.

In the first embodiment, the first tail portion 204 has a first flange 216 and a second flange 218. The flanges 216,218 extend from the distal sides or edges of the first tail portion 204. The first shield member 210 integrally and electrically connects to the first flange 216. The second shield member 212 integrally and electrically connects to the second flange 218. The second tail portion 206 has a first flange 220 and a second flange 222. The flanges 220,222 extend from the distal sides or edges of the second tail portion 206. The first shield member 210 non-integrally and electrically contacts the first flange 220. The second shield member 212 non-integrally and electrically contacts the second flange 222.

The first shield member 210 is substantially perpendicular to the first tail portion 204 and the second tail portion 206. The second shield member 212 is substantially perpendicular to the first tail portion 204 and the second tail portion 206. The second shield member 212 is spaced from and substantially parallel to the first shield member 210. The first shield member 210, the second shield member 212, the first tail portion 204 and the second tail portion 206 define a pocket 224 for enclosing tails of the terminals 20 in the same column as the integral ground terminal and tail shield 200.

Figure 3:
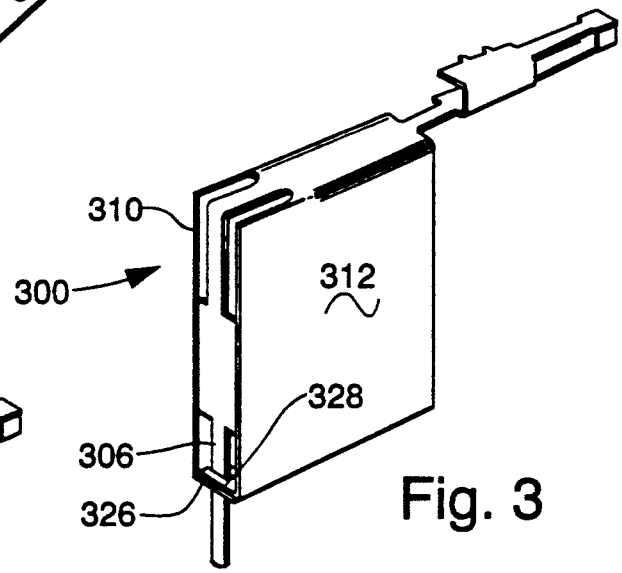
FIG. 3 is a perspective view of a second embodiment of the integral ground terminal and tail shield for use in a receptacle in accordance with the present invention which is similar to the first embodiment of FIG. 2 with displacement contacts.

FIG. 3 illustrates a second embodiment 300 of the integral ground terminal and tail shield 100 of the present invention. The second embodiment 300 is the same as the first embodiment 200, except the second embodiment 300 includes a first displacement contact 326 and a second displacement contact 328. The first displacement contact 326 has a slot for receiving in an interference fashion and, thus, electrically contacting the second tail portion 306. The first displacement contact 326 is integrally connected to the first shield member 310 at a bend. The second displacement contact 328 has a slot for receiving in an interference fashion and, thus, electrically contacting the second tail portion 306. The second displacement contact 328 is integrally connected to the second shield member 312 at a bend. Displacement contacts, like displacement contacts 326,328, can be on any of the embodiments disclosed herein. Displacement contacts, like displacement contacts 326,328, can even be used to connect the shield members to the first tail portion, such as, in the embodiment illustrated in FIG. 4.

Figure 4:
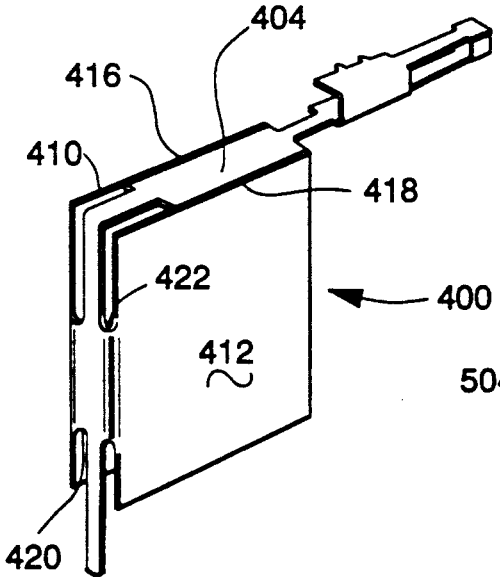
FIG. 4 is a perspective view of a third embodiment of an integral ground terminal and tail shield for use in a receptacle in accordance with the present invention.

Referring to FIG. 4, there is illustrated a third embodiment 400 of the integral ground terminal and tail shield 100 of the present invention. The third embodiment 400 can be the same as the first embodiment 200, except in the third embodiment 400 the first shield member 410 non-integrally and electrically contacts the first flange 416. The second shield member 412 non-integrally and electrically contacts the second flange 418. The first shield member 410 integrally and electrically connects to the first flange 420. The second shield member 412 integrally and electrically connects to the second flange 422.

Figure 5:
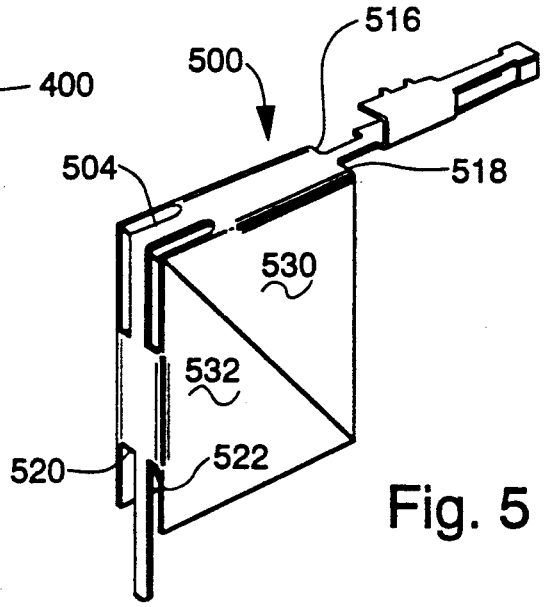
FIG. 5 is a perspective view of a fourth embodiment of an integral ground terminal and tail shield for use in a receptacle in accordance with the present invention.

FIG. 5 illustrates a fourth embodiment 500 of the integral ground terminal and tail shield 100 of the present invention. The fourth embodiment 500 can be the same as the first embodiment 200, except the first and second shield members 510,512 have first shield members or sections 530 and second shield members or sections 532. The first sections 530 are integrally connected to the first and second flanges 516,518 of the first tail portion 504. The second sections 532 are integrally connected to the first and second flanges 520,522 of the second tail portion 506. The first and second sections 530,532 of each shield member 510,512 are non-integrally and electrically contacting each other. Since the first members or sections 530 are non-integrally and electrically contacting the second members or sections 532 and since the second members or sections 532 are integrally a part of the second tail portion 506 through its flanges 520,522, then it follows that the first members or sections 530 are non-integrally and electrically contacting the second tail portion 506 (through the second members or sections 532). Similarly, since the second members or sections 532 are non-integrally and electrically contacting the first members or sections 530 and since the first members or sections 530 are integrally a part of the first tail portion 504 through its flanges 516,518, then it follows that the second members or sections 532 are non-integrally and electrically contacting the first tail portion 504 (through the first members or sections 530).

Figure 6:
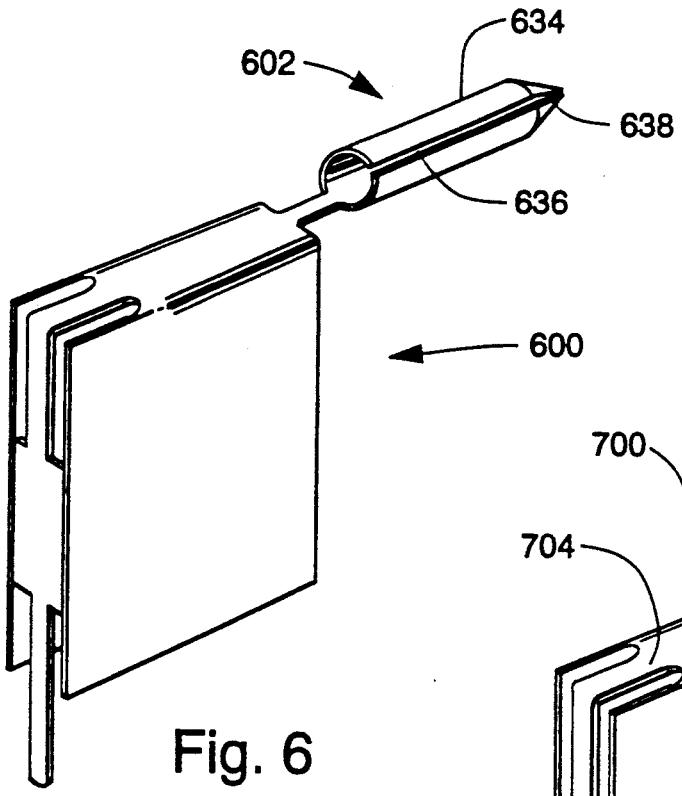
FIG. 6 is a perspective view of a fifth embodiment of an integral ground terminal and tail shield for use in a header in accordance with the present invention.
Figure 7:
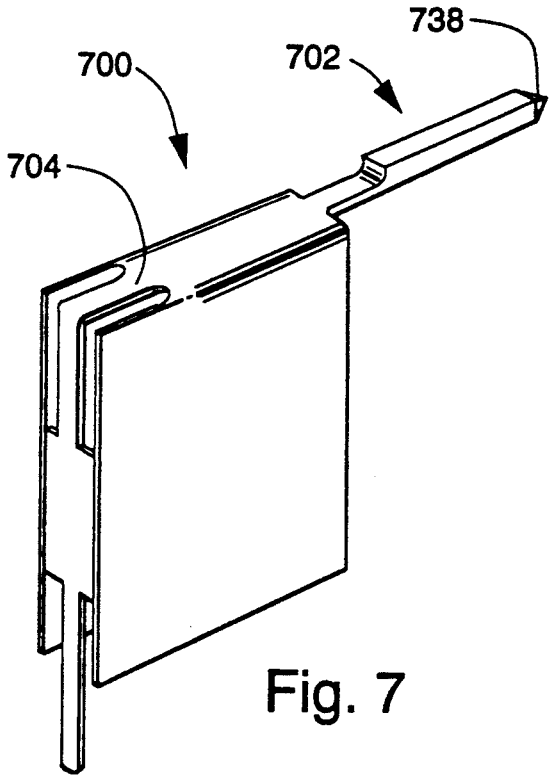
FIG. 7 is a perspective view of a sixth embodiment of an integral ground terminal and tail shield for use in a header in accordance with the present invention.
Figure 8:
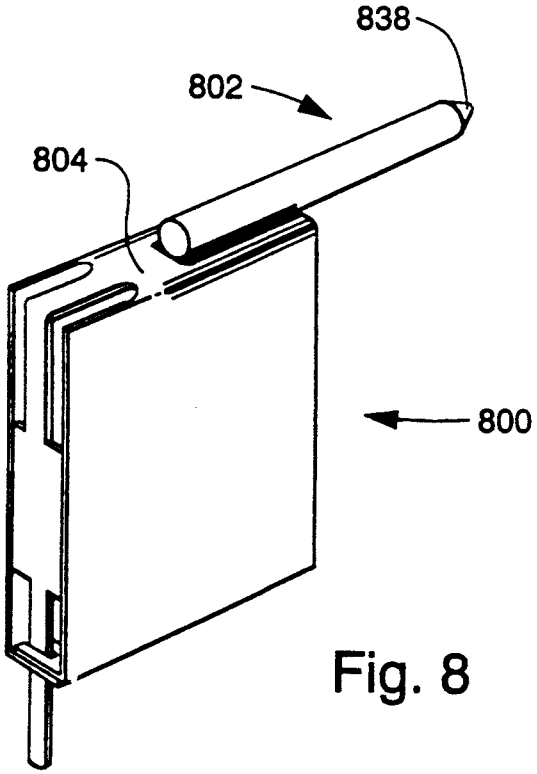
FIG. 8 is a perspective view of a seventh embodiment of an integral ground terminal and tail shield for use in a header in accordance with the present invention.

FIGS. 6–8 illustrate a fifth, a sixth and a seventh embodiment 600, 700 and 800, respectively, of the integral ground terminal and tail shield 100 of the present invention. The fifth, sixth and seventh embodiments 600, 700 and 800, respectively, illustrate three alternative designs for the first contact end portion designated by numbers 602, 702 and 802, respectively. Any one of these first contact end portions 602, 702 and 802 can be on any of the embodiments disclosed in this specification. The fifth and sixth embodiments 600 and 700, respectively, are the same as the the first embodiment 200, except their first contact end portions 202,602,702 are different. The seventh embodiment 800 is the same as second embodiment 300, except their first contact end portions 302,702 are different.

The first contact end portion 602 of the fifth embodiment 600 is rolled from flat stock of sheet metal forming a cylindrical body 634 with a longitudinal slit 636. The first contact end portion 602 has either a claim shell tip or a tapered tip 638 to facilitate insertion of the first contact end portion 602 into a mating connector.

The first tail portion 702 of the sixth embodiment 700 is formed from flat stock of sheet metal having a first thickness which is the desired thickness of the first tail portion 702. The sheet metal is milled to remove a layer of the metal off the sheet to form the lower surface of the first contact end portion 704 and the rest of the integral ground terminal and tail shield 700. Then the integral ground terminal and tail shield 700 is cut or trimmed from the milled sheet. The first contact end portion 702 is preferably cut to have a substantially square cross section, perpendicular to its longitudinal axis. The first contact end portion 702 also has a tapered tip 738 to facilitate insertion of the first contact end portion 702 into a mating connector.

The first contact end portion 802 of the seventh embodiment 800 is a cylindrical pin which is welded or soldered to the first tail portion 804. The first contact end portion also has a conical tip 838 to facilitate insertion of the first contact end portion 802 into a mating connector.

Figure 9:
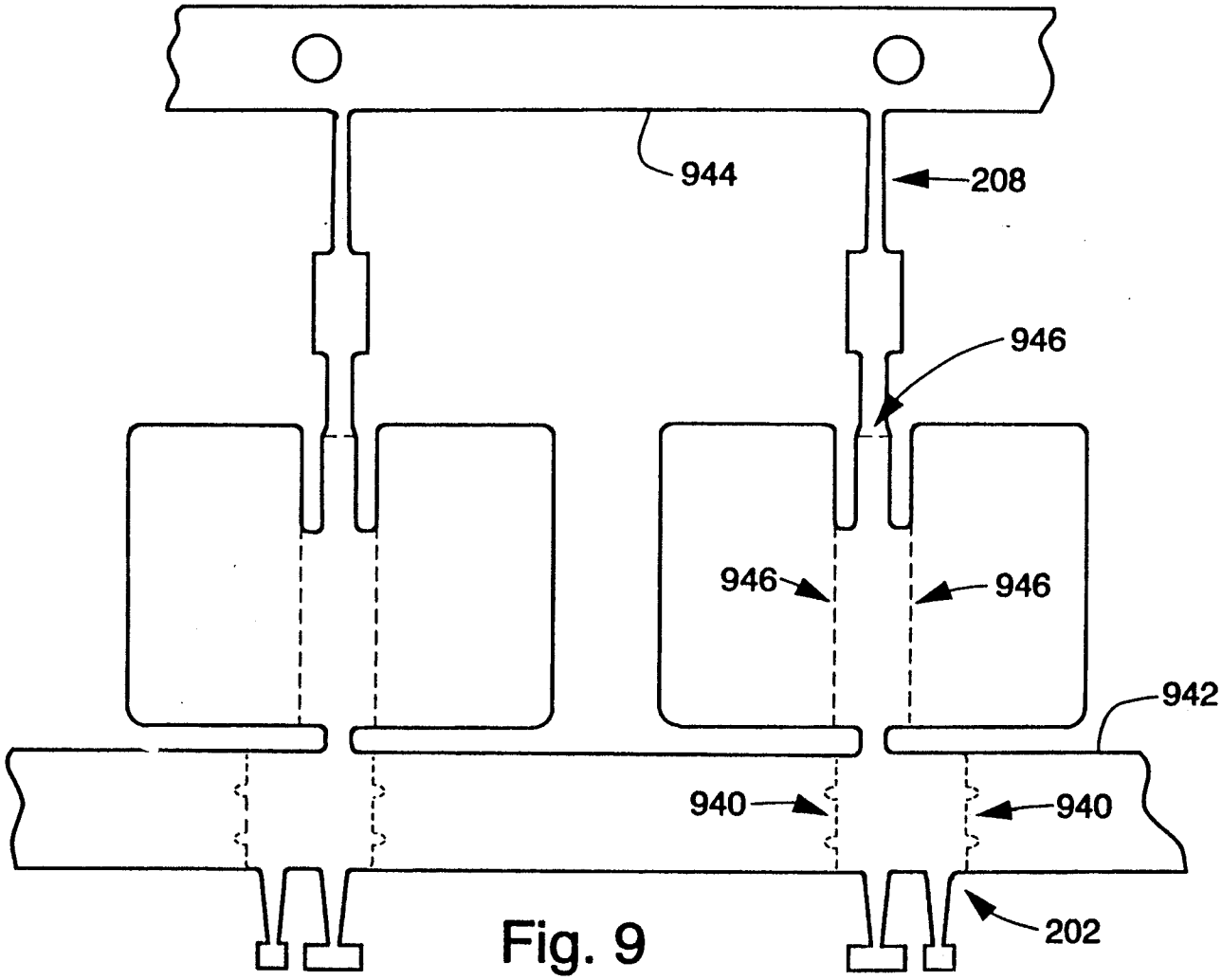
FIG. 9 illustrates a method of manufacturing the integral ground terminal and tail shield of the present invention in a flat strip of metal.

Each of the embodiments of the integral ground terminal and tail shield 100 disclosed herein can be made from flat stock of a suitable metal. To illustrate, FIG. 9 is a plan view of flat stock which has been initially trimmed to a shape from which the integral ground terminal and tail shield 200 can be formed through one or a series of subsequent trimming steps and bending or folding steps. In one of the subsequent trimming steps, the remainder of the first contact end portion 202 is cut on dashed lines 940 from a first or front carrying strip 942. The second contact end portion 208 is cut from a strip connected to a second or rear carrying strip 944. Dashed lines 946 indicate regions where the flat metal is folded to form the shape of the integral ground terminal and tail shield 200 illustrated in FIG. 2.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. A connector for interconnecting a mating connector and a circuit assembly, comprising:

an insulative housing;

a plurality of terminals arranged in rows and columns in the housing;

at least one integral ground terminal and tail shield in one of the columns and comprising:

a first contact end portion for contacting a mating terminal contact portion in the mating connector;

a first, substantially flat, longitudinal, tail portion connected to the first contact end portion;

a second, substantially flat, longitudinal, tail portion connected to the first tail portion at a bend;

a second contact end portion terminating the second tail portion, the second contact end portion for being connected to the circuit assembly;

a first, substantially flat, shield member integrally connected to one of the first tail portion and the second tail portion, the first shield member non-integrally electrically contacting the other one of the first tail portion and the second tail portion, the first shield member being substantially perpendicular to the first tail portion and the second tail portion; and a second, substantially flat, shield member integrally connected to one of the first tail portion and the second tail portion, the second shield member non-integrally electrically contacting the other one of the first tail portion and the second tail portion, the second shield member being substantially perpendicular to the first tail portion and the second tail portion; and the first and second shield members and the first and second tail portions of the integral ground terminal and tail shield defining a pocket for enclosing tails of a plurality of the terminals in the same column as the integral ground terminal and tail shield.

2. The connector of claim 1, wherein:

the first tail portion has a first flange and a second flange, the flanges extending from distal sides of the first tail portion;

the first shield member non-integrally contacting the first flange; and the second shield member non-integrally contacting the second flange.

3. The connector of claim 1, wherein:

the first shield member being integrally connected to the first tail portion and non-integrally connected to the second tail portion.

4. The connector of claim 1, wherein:

the first shield member being non-integrally connected to the first tail portion and integrally connected to the second tail portion.

5. The connector of claim 1, further comprising:

a first displacement contact having a slot receiving the second tail portion, the first displacement contact connected to the first shield member at a bend; and a second displacement contact having a slot receiving the second tail portion, the second displacement contact connected to the second shield member at a bend.

6. The connector of claim 1, wherein:

the first contact end portion being a socket or pin shaped.

7. An integral ground terminal and tail shield, comprising:

a first contact end portion for contacting a mating terminal contact portion;

a first, substantially flat, longitudinal, tail portion connected to the first contact end portion;

a second, substantially flat, longitudinal, tail portion connected to the first tail portion at a bend;

a second contact end portion terminating the second tail portion, the second contact end portion for being connected to a circuit assembly;

a first, substantially flat, shield member integrally connected to at least one of the first tail portion and the second tail portion, the first shield member at least electrically contacting the other one of the first tail portion and the second tail portion, the first shield member being substantially perpendicular to the first tail portion and the second tail portion;

a second, substantially flat, shield member integrally connected to at least one of the first tail portion and the second tail portion, the second shield member at least electrically contacting the other one of the first tail portion and the second tail portion, the second shield member being substantially perpendicular to the first tail portion and the second tail portion;

the second tail portion has a first flange and a second flange, the flanges extending from distal sides of the second tail portion;

the first shield member non-integrally contacting the first flange; and the second shield member non-integrally contacting the second flange.

8. An integral ground terminal and tail shield for use in a connector having a plurality of terminals arranged in rows and columns, comprising:

a first contact end portion for contacting a mating terminal contact portion;

a first, substantially flat, longitudinal, tail portion connected to the first contact end portion;

a second, substantially flat, longitudinal, tail portion connected to the first tail portion at a bend;

a second contact end portion terminating the second tail portion, the second contact end portion for being connected to a circuit assembly;

a first, substantially flat, shield member integrally connected to at least one of the first tail portion and the second tail portion, the first shield member at least electrically contacting the other one of the first tail portion and the second tail portion, the first shield member being substantially perpendicular to the first tail portion and the second tail portion; and a second, substantially flat, shield member integrally connected to at least one of the first tail portion and the second tail portion, the second shield member at least electrically contacting the other one of the first tail portion and the second tail portion, the second shield member being substantially perpendicular to the first tail portion and the second tail portion, such that when the integral ground terminal and tail shield is used as one of the terminals in one of the columns of the connector having the plurality of terminals arranged in rows and columns, the first and second shield members and the first and second tail portions define a pocket for enclosing tails of a plurality of the terminals in the same column as the integral ground terminal and tail shield; wherein:

the second tail portion has a first flange and a second flange, the flanges extending from distal sides of the second tail portion;

the first shield member non-integrally contacting the first flange; and the second shield member non-integrally contacting the second flange.

9. A connector for interconnecting a mating connector and a circuit assembly, comprising:

an insulative housing;

a plurality of terminals arranged in rows and columns in the housing;

at least one integral ground terminal and tail shield in one of the columns and comprising:

a first contact end portion for contacting a mating terminal contact portion in the mating connector;

a first, substantially flat, longitudinal, tail portion connected to the first contact end portion;

a second, substantially flat, longitudinal, tail portion connected to the first tail portion at a bend;

a second contact end portion terminating the second tail portion, the second contact end portion for being connected to the circuit assembly;

a first, substantially flat, shield member integrally connected to at least one of the first tail portion and the second tail portion, the first shield member at least electrically contacting the other one of the first tail portion and the second tail portion, the first shield member being substantially perpendicular to the first tail portion and the second tail portion;

a second, substantially flat, shield member integrally connected to at least one of the first tail portion and the second tail portion, the second shield member at least electrically contacting the other one of the first tail portion and the second tail portion, the second shield member being substantially perpendicular to the first tail portion and the second tail portion;

the first and second shield members and the first and second tail portions of the integral ground terminal and tail shield defining a pocket for enclosing tails of a plurality of the terminals in the same column as the integral ground terminal and tail shield;

the second tail portion has a first flange and a second flange, the flanges extending from distal sides of the second tail portion;

the first shield member non-integrally contacting the first flange; and the second shield member non-integrally contacting the second flange.

* * * * *